US006058671A

United States Patent [19]

Strickland

[11] Patent Number: 6,058,671

[45] Date of Patent: May 9, 2000

[54] SHIM FOR MODULAR BUILDING PANELS AND METHOD FOR USING THE SAME

[75] Inventor: Michael Strickland, Richmond Hill, Canada

[73] Assignee: Canam Manac Group, Inc., Quebec, Canada

[21] Appl. No.: 09/046,758

[22] Filed: Mar. 24, 1998

[51] Int. Cl.[7] ..... E04B 2/56

[52] U.S. Cl. ..... 52/580; 52/585.1; 52/393; 52/745.1; 52/792.1; 411/539

[58] Field of Search ..... 52/393, 404.1, 52/579, 580, 582.1, 582.2, 584.1, 585.1, 742.1, 745.1, 745.13, 747.1, 787.1, 792.1; 411/535, 536, 539, 546

[56] References Cited

U.S. PATENT DOCUMENTS

| | | | |
|---|---|---|---|
| 2,158,234 | 5/1939 | Griebsch | 52/393 |
| 2,825,098 | 3/1958 | Hultquist | 52/580 |
| 3,285,568 | 11/1966 | Biach | 411/539 X |
| 3,832,812 | 9/1974 | Hiatt | 52/580 X |
| 3,975,878 | 8/1976 | Modarelli, Jr. | 52/393 X |
| 4,070,848 | 1/1978 | Lingle | 52/792.1 X |
| 4,558,548 | 12/1985 | Heiger | 411/539 X |
| 4,809,421 | 3/1989 | Justice | 411/539 X |

*Primary Examiner*—Carl D. Friedman
*Assistant Examiner*—Kevin D. Wilkens
*Attorney, Agent, or Firm*—William A. Loginov; Cesari and McKenna, LLP

[57] ABSTRACT

A method and apparatus for providing for expansion and contraction in modular building panels provides a quickly insertable shim structure that can be placed between modular building panels adjacent bolt that secures the panels together. The shim is inserted into a gap formed between two adjacent members that are to be joined from a location external to the panels. The shim is U-shaped so that it passes over a bolt for securing the members together. When the bolt is tightened, the shim forms a permanent gap-forming structure. The adjacent members can be vertical members or horizontal members. This shim is inserted at a location on the adjacent members between interconnected transverse members so that the transverse members can expand into the gap with corresponding flexure about the shim of the adjacent members.

10 Claims, 5 Drawing Sheets

SHIM FOR MODULAR BUILDING PANELS AND METHOD FOR USING THE SAME

FIELD OF THE INVENTION

This invention relates to modular buildings having wall sections that are prefabricated and joined together using bolts and more particularly to a shim located between panels adjacent to bolts.

BACKGROUND OF THE INVENTION

It has become increasingly popular, particularly in the construction of commercial and industrial buildings and facilities to use prefabricated wall sections that are constructed off site and subsequently joined together at the building site. The panels are manufactured in a factory setting and can be either a standard shape or custom built. One source of such modular building systems is available from the Canam Manac Group of Canada under the trademark of MUROX™.

The panels are typically formed from a frame work of structural steel members. A generally rectangular outlined shape is typically produced. The outer edges of the panel usually comprise the main structural members that provide the panels with rigidity. For example, a pair of vertical members are often used on each upright edge of the panel. The vertical members are typically formed as channel-shaped beams in which the bottom leg of the channel comprises the outer edge of the panel while the upright legs of the channel extend inwardly toward the center of the panel. At least two horizontal cross members are provided at the top and bottom edges of the panel. The cross members extend horizontally between the two channel-shaped vertical members and are usually joined to the channel-shaped vertical members by welding, bolting, riveting or another acceptable joining technique. The interior of the panel can be filled with a variety of insulation materials and other fillings. Utilities can be prearranged inside the panel. Each side of the panel can be provided with an appropriate skin covering. Panels are brought to a building site and assembled together using bolts that typically join two of the channel-shaped upright members together so that the panels are arranged side by side to form a completed wall. In general the vertical U-shaped members are joined using bolts that pass through holes in each of the members. The holes can be predrilled in each panel before assembly, or can be drilled on site after the panels have been aligned with each other. Bolts are used to lock the panels together at the construction site.

Since horizontal members are prone to expand and contract due to thermal expansion, it is desirable to include expansion joints between panels. A variety of techniques have been used to create expansion joints. Typically, packing or other spacers can be prearranged between specific panels to allow groups of panels to expand and contract. In a standard size building expansion can account for an inch or more of horizontal movement over the length of a wall. A disadvantage to providing expansion joints is that it often slows down the construction process and can induce inaccuracies and misalignments in the joining of building panels. For this reason, joints are often established only where specifically needed along the length of the wall.

It is therefore an object of this invention to provide a method and apparatus for quickly and reliably accounting for expansion and contraction in assembled modular building panels.

SUMMARY OF THE INVENTION

A method and apparatus for providing for expansion and contraction in modular building panels, according to this invention, overcomes the disadvantages of the prior art by providing a quickly insertable shim structure that can be placed between modular building panels adjacent bolt that secures the panels together. The shim is inserted into a gap formed between two adjacent members that are to be joined from a location external to the panels. The shim is U-shaped so that it passes over a bolt for securing the members together. When the bolt is tightened, the shim forms a permanent gap-forming structure. The adjacent members can be vertical members or horizontal members. This shim is inserted at a location on the adjacent members between interconnected transverse members so that the transverse members can expand into the gap with corresponding flexure about the shim of the adjacent members.

The gap between the two upright members enables the horizontal members to flex the upright members slightly toward and away from each other, thus allowing each joint between panels to act as an expansion joint. Typically, a bolt hole or other fastening location is provided midway between a pair of horizontal members on confronting vertical members. The vertical members are unjoined adjacent respective horizontal members allowing free expansion and contraction relative to the gap. It is contemplated that the shim can also be provided midway along confronting horizontal members, as well, enabling panels on adjacent floors or levels to be joined with quickly created expansion gaps. The shim, in particular allows expansion joints to be established quickly, reliably and accurately between every joined modular panel in a structure.

BRIEF DESCRIPTION OF THE DRAWINGS

The foregoing and other objects and advantages of the invention will become more clear with reference to the following detailed description as illustrated by the drawings in which.

DETAILED DESCRIPTION

Figure 1:
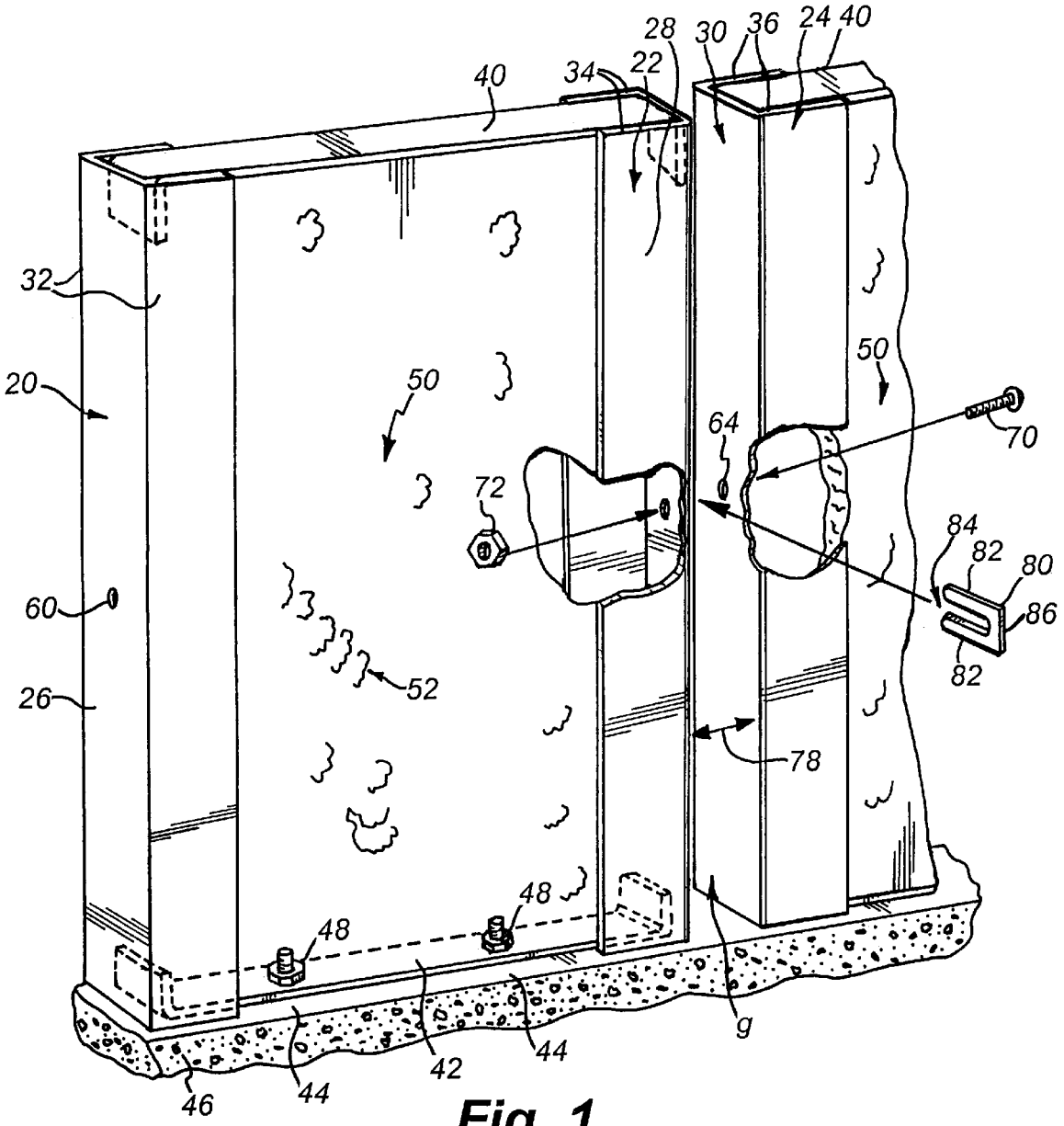
FIG. 1 is a partially exposed perspective view of a pair of building panels to be joined with a shim according to this invention.

FIG. 1 details a basic technique for joining two modular wall panels of a building according to this invention. The wall panels, as described above, each comprise a spaced-apart channel-shaped vertical members 20, 22 and 24 in which the flat base 26, 28 and 30, respectively, projects outwardly and a pair of parallel legs 32, 34 and 36, respectively, form the side plates, extending inwardly from each respective base. Each base, in this embodiment, is tied to an opposing base by a pair of top and bottom horizontal frame members 40 and 42, respectively. The bottom frame members 42 each include holes for receiving anchor bolts 44 that secure the bottom horizontal members 42 to a foundation 46. Respective nuts 48 are used to secure the bottom horizontal members 42 to the foundation 46. It is contemplated that a variety of securing structures can be used to anchor panels to a foundation including adhesives, rods and weldments. Note that terms left, right, top and bottom are used herein as conventions for purposes of illustration, and that in practice, any orientation is contemplated.

Between the top and bottom horizontal members 40 and 42 is located airspace 50 that can be filled with a variety of filling materials such as insulation 52. Any acceptable wall surface can be located along the interior and exterior faces of each panel to enclose the insulation or other filling material within the panel and to define the interior and exterior walls of the structure. For example, dry wall or corrugated metal can be located along an interior wall. Corrugated metal, brick work or another suitable material can be used along an exterior wall. Appropriate polymer or other membranes can be provided as a vapor barrier on the interior and/or exterior faces of each panel.

Located on each vertical member 20, 22 and 24, approximately midway between the top and bottom horizontal members 40 and 42 is positioned a through hole 60, 62 and 64, respectively. The through holes are aligned vertically so that adjacent through holes 62 and 64 overlap each other. The holes can be provided to each vertical member, as appropriate, before the panels are positioned at the building site. Alternatively, holes can be drilled on site using an appropriate drilling device and drilling fixture. Similarly, while one hole is provided between horizontal members 40 and 42, a plurality of holes can be provided between the members. The provision of holes is subject to the dynamics of the panels which will be described further below. The holes 60, 62 and 64 receive fasteners which, in this embodiment, comprise threaded bolts 70 and corresponding nuts 72. Self-threading bolts, rivets of various types, or other fasteners can be employed according to alternate embodiments.

In construction, panels are aligned as shown in FIG. 1 with respective adjacent holes 62, and 64 placed in an overlapping relationship. The panels are moved toward each other double arrow 78 so that a gap g still remains between the panels. This gap can be approximately ¼ inch. or less according to one embodiment. The gap is shown as oversized in this illustration for purposes of clarity. Slots, (not shown) can be provided in the bottom horizontal member 42 to enable the panels to slide over a limited distance in the direction of the double arrow 78 enabling the gap to be varied while the panels are still mounted on the anchor bolts 44. In general the nuts 48 of the anchor bolts 44 are not tightened until the vertical members are permanently secured to each other by the bolt 70 and nut 72. In order to maintain an appropriate gap g an insertable shim 80 is provided at the bolt 70 to maintain the gap g between the vertical members 22 and 24. The shim 80 includes a pair of leg members 82 that define an open slot 84 with a base member 86 that joins the two leg members 82. The slot 84 is received by the bolt 70. Typically, the width of the slot is the same or larger than the outer diameter of the bolt 70. The shim 80 according to this embodiment has a shape that advantageously enables it to be inserted from either the interior or exterior side of the panels easily during panel assembly.

Figure 2:
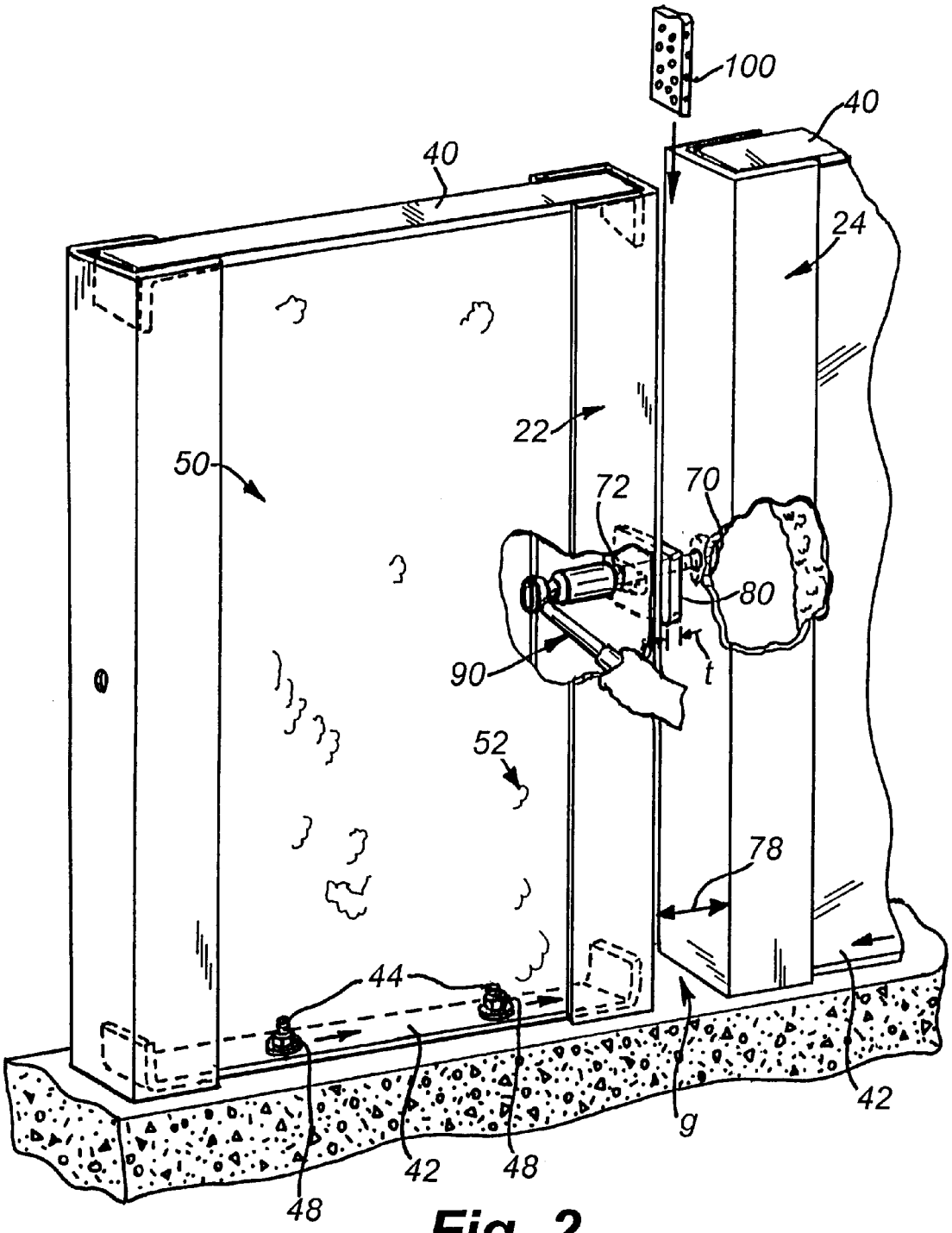
FIG. 2 is a partially exposed perspective view of the panels of FIG. 1 being secured.

With reference to FIG. 2, once the shim is inserted, the bolt 70 and nut 72 can be tightly secured using, for example, a hand-operated socket wrench 90. The thickness t of the shim will define the final thickness of the gap g. Tightening of the bolt 70 may cause the panels to move toward each other (double arrow 78) which, in turn, causes the bottom horizontal members 42 to slide relative to their anchor bolts 44 and anchor nuts 48. Alternatively, the gap g can be predefined to be approximately the same as the thickness t of the shim 80. As such, little or no movement of the panels relative to each other along the direction of the double arrow 78 will occur. In this example, the anchor bolts 44 and nuts 48 can be secured tightly before the nut 70 and bolt 72 are tightened around the shim 80. Typically, the bolt 70 and nut 72 are tightened by accessing each of the bolt and the nut to either the interior or exterior face of each panel. Typically, the nut and bolt are accessed before a final covering surface is applied to the respective interior or exterior face. Insulation and other materials surrounding the bolt are moved to side to enable access. The materials can be replaced, or alternatively, small panels of insulation and other filling materials can be inserted adjacent the bolt locations after the securing process is completed. During the securing process weather stripping or other gap filling insulation 100 can be inserted into the gap g between the panels. This insulation is typically soft and playable for reasons to be described below.

Figure 3:
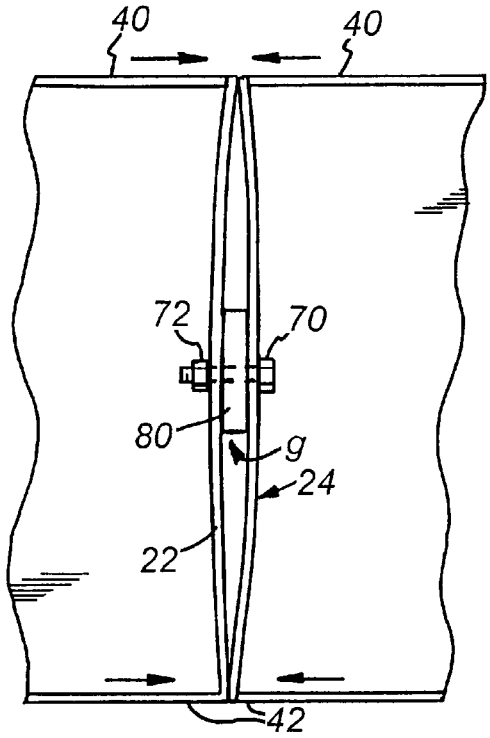
FIG. 3 is a somewhat schematic side view illustrating thermal expansion into the gap between building panels.

FIG. 3 details schematically thermal expansion experienced by wall panels following assembly. The top and bottom horizontal members 40 and 42, respectively are shown expanding toward each other and into the gap g. The gap g, therefore, provided room for expansion of the horizontal members. This expansion causes associated deflection in the vertical members 22 and 24 about the centrally located shim 80. Likewise, contractions of the horizontal members 40 and 42 (not shown) causes deflection of the vertical members 22 and 24 away from each other about the shim 80. The relative spacing of the vertical members 22 and 24 about the shim 80 does not change. Typically the deflection is small enough that it occurs elastically (e.g., without plastic or permanent deformation of the vertical and horizontal members). Maintaining a gap g between the panels using the shim 80 enables the joint between each of the panels to act automatically as an expansion joint. Hence, specially expansion joints need not be provided at specific locations along the walls of a modular building constructed according to this embodiment. Likewise, the construction of automatic expansion joints according to this invention is fast, easy and uniformed using the easily insertable shim 80 according to this invention.

Figure 4:
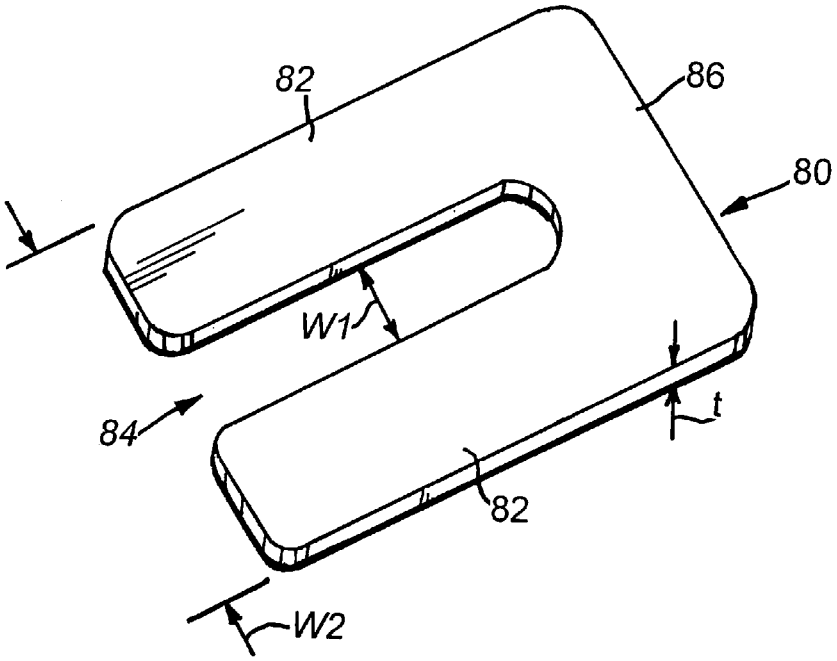
FIG. 4 is a perspective view of a typical shim according to this invention.
Figure 5:
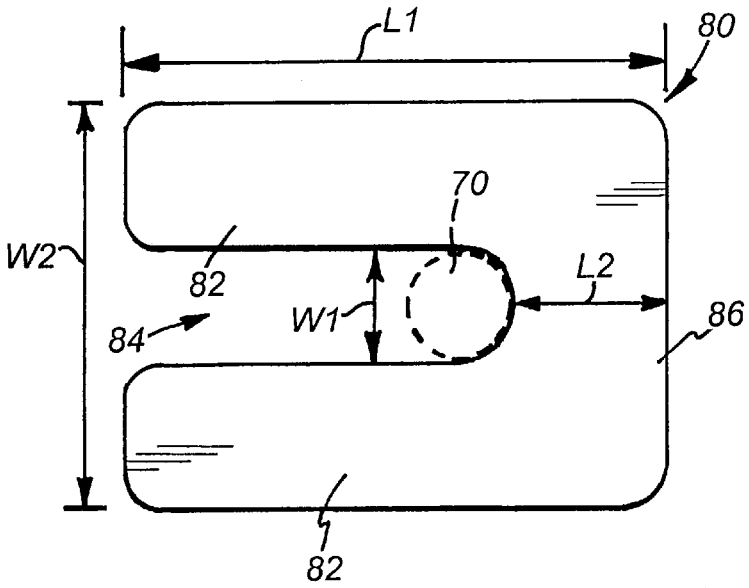
FIG. 5 is a plan view of the shim of FIG. 4.

FIGS. 4 and 5 further detailed the dimensions of a shim 80 according to one embodiment of this invention. It is contemplated that shims having a variety of sizes and thicknesses t can be utilized for different applications According to a conventional application the average joint expands at least 1/32 inch. Hence, the gap must be larger than this expansion distance. In this embodiment, the thickness t is approximately ¼ inch. Structural steel rated at 36 KSI is used to form the shim. The bolt diameter varies from between ⅝ inch and 1 and ¼ inch. Accordingly, the width W1 of the slot is typically between ⅝ inch and 1¼ inch. The width WI maybe oversized by 1/16 inch or more with respect to the bolt diameter. The vertical members are conventional channel beams formed by hot rolling processes. The gauge of the steel used is conventional and depends upon the size and load characteristics of the panel. Horizontal members are typically sixteen gauge structural steel. There are arc welded, riveted or bolted to the vertical members. They are formed by a colt forming process according to a preferred embodiment. The overall width W2 of the shim in one embodiment is approximately 3 inches. The overall length L1 of the shim is approximately 4 inches. The length L2 between the end wall of the base 86 and the end of the slot 84 is approximately 1 inch. These dimensions can be varied, and the materials used can also be varied depending on the particular application, configuration and size of the panels employed.

Figure 6:
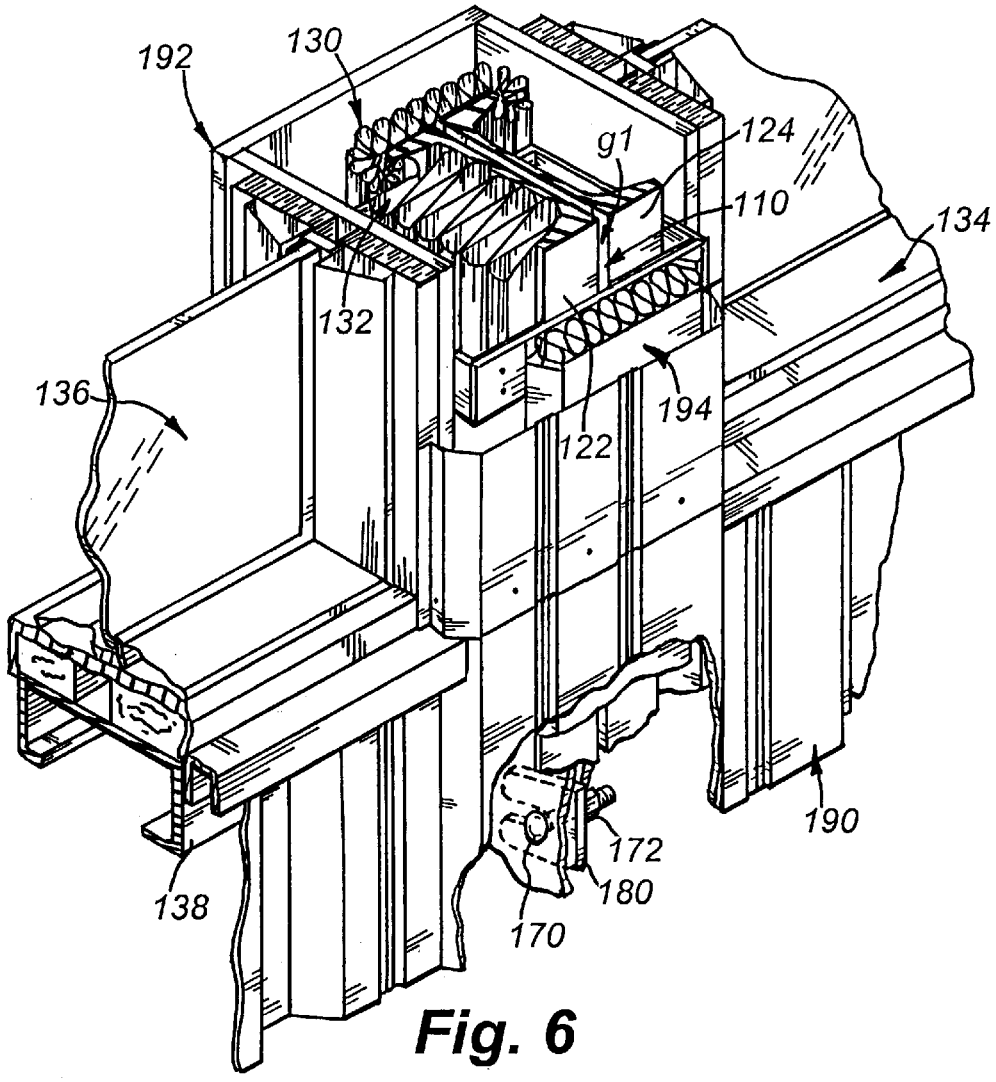
FIG. 6 is a more-detailed cut-away perspective view of a pair of modular building panels secured with a shim according to his invention.

FIG. 6 is an exposed view of an assembled modular building section including the joint 110 formed between two panels. A gap g1 is formed at the joint 110 between two internally disposed vertical channel members 122 and 124. Insulation 130 and 132 has been provided around the channels. Modules, according to this invention can include a variety of openings including the windows 134 and 136. The windows, in this embodiment, are supported on horizontal cross-members 138. Between horizontal members is provided the shim 180 according to this invention that is secured about the bolt 170 and nut 172. The shim and its nut and bolt are typically provided to join the vertical members 122 and 124 before covering materials 190, 192 and insulation 194 is applied to the face(s) of the modules. In this embodiment, the outer covering 192 comprises a sheet material such as concrete board or stress-skin paneling. The inner covering 190 comprises a corrugated steel sheet.

Figure 7:
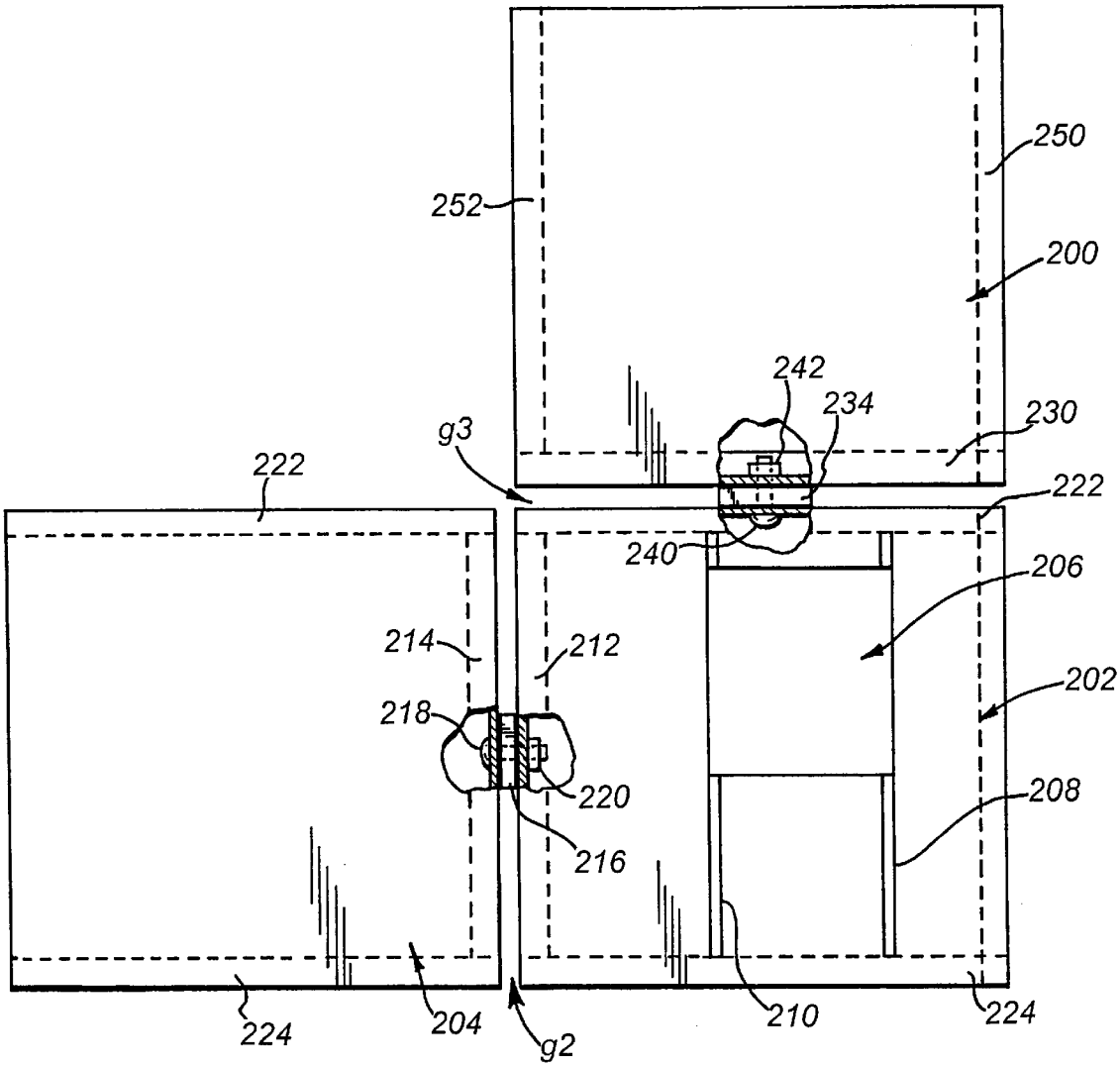
FIG. 7 is a somewhat schematic side view of vertical and horizontal panels joined using shims according to this invention.

FIG. 7 illustrates both horizontal and vertical assembly of modules 200, 202 and 204 according to an embodiment of this invention. Note the module 202 includes a window hole 206 according to this invention formed between non-structural vertical members 208 and 210. The modules 202 and 204 are joined according to the above described embodiment between adjacent structural vertical members 212 and 214 using a shim 216 of a type generally described in this invention. A bolt 218 and nut 220 secures the joint. The joint is positioned between respective horizontal members 222, 224 on each module 202 and 204 to enable flexure into the gap g2 as described above. The top horizontal member 222 on module 202 is also secured to a bottom horizontal member 230 on the upper module 200. A shim 234 of a type described above is provided adjacent the bolt 240 and nut 242 that secures the modules 200 and 202 together. The joint is formed between respective vertical members 250 and 252 on the module 200. This enables flexure, based upon expansion of the vertical members into the gap g3 formed between the modules 200 and 202. Hence, the shim assembly according to this invention can be used to quickly define expansion gaps between both vertical seams and horizontal seams between modules. It is contemplated, primarily, that interconnections, using the shims according to this invention, be located along free, unconnected portions of adjacent members so that expansion of the interconnected members (at their respective connection points with the joined members) can occur freely.

The foregoing has been a detailed description of preferred embodiments of the invention. This description can be modified without departing from the spirit or scope of the invention. For example, while the shim is shown as a rectangular member, the outer perimeter of the shim can define any acceptable perimeter shape, such as circular, ovular or trapezoidal. It is contemplated mainly that the shim includes a pair of legs with a notch therebetween for receiving a bolt or other fastener. Likewise, a variety of shapes of vertical and horizontal members can be employed. For example, vertical and/or horizontal members can comprise square or rectangular-cross-section members. While not shown, modules can include a variety of support structures and/or preassembled utilities. In particular, modules can include supporting structures for supporting floor and/or ceiling joist according to this invention. It is particularly noted that two channel members, that form vertical members, when joined together define, essentially, a full I-beam for supporting such a joist. Accordingly, this description is meant to be taken only by way of example, and not to otherwise limit the scope of the invention.

What is claimed is:

1. A system for constructing structures having modular wall panels comprising:

a first wall panel and a second wall panel each of the first wall panel and the second wall panel having a respective first pair of supports and a respective second pair of supports that interconnect the first pair of supports, the second pair of supports being spaced apart from each other along a length of each of the first pair of supports, one of the first pair of supports of said first panel being adjacent to one of the first pair of supports of said second panel and defining therebetween a gap;

a fastener passing through each of the adjacent ones of the first pairs of supports at a location between each of the second pair of supports wherein the first pair of supports are constructed and arranged to flex over an expansion distance into the gap based upon predetermined thermal expansion of the second pair of supports; and a shim having a pair of legs that therebetween define a slot with an opening and a base member opposite the opening that connects the legs, the legs surrounding the fastener when the fastener is passed between the adjacent ones of the first pairs of supports, whereby the shim defines therebetween a gap having a distance that is sized larger than the expansion distance of the pair of supports thereinto.

2. The system as set forth in claim 1 wherein the fastener comprises a bolt and a nut.

3. The system as set forth in claim 1 further comprising a flexible filling material located in the gap constructed and arranged to enable each of the adjacent first pair of members to flex into the gap based upon expansion of the second pair of members.

4. The system as set forth in claim 1 wherein each of the first pair of supports comprises a vertical member extending upwardly from a ground surface and wherein each of the second pair of supports comprises a horizontal member interconnected with and extending between the first pair of supports.

5. The system as set forth in claim 4 wherein each vertical member comprises a channel beam having a base wall and a pair of side walls extending from opposite ends of the base wall and wherein the respective base wall of each of the adjacent ones of the first pairs of vertical members are joined by the fastener in a confronting arrangement.

6. The system as set forth in claim 1 wherein the shim defines a rectangular outline and wherein the legs are parallel to each other, defining a pair of parallel inner-facing sides therebetween that form the slot.

7. The system as set forth in claim 6 wherein the shim is constructed from structural steel.

8. A method for forming expansion joints between modular wall panels having a first pair of members interconnected by a second pair of members that are spaced apart from each other remotely relative to the first pair of members comprising the steps of:

locating one of the first pair of members of one of the panels adjacent to another of the first pair of members of another of the panels and defining therebetween a gap;

providing a location for inserting a fastener between each of the adjacent first pair of members, the location being remote from each of the second pair of members, the location is defined so that the first pair of members are allowed to flex into the gap based upon predetermined thermal expansion of the second pair of members;

inserting a shim having a pair of legs with an opening at a first end and a base at a second end over the fastener when the fastener is located at the location; and after inserting the shim, securing the fastener so that the adjacent first pair of members are in pressurable engagement with the shim, whereby an expansion gap having a thickness approximately equal to a thickness of the shim is formed between each of the adjacent first pair of members.

9. The method that set forth in claim 8 wherein the step of securing includes tightening a threaded bolt and nut with respect to each other.

10. The method as set forth in claim 9 further comprising defining a wall of a building comprising a plurality of panels each having a pair of opposing vertical members, locating vertical members adjacent to each other along the wall, and performing the steps of inserting and securing with a respective shim to each of the plurality of adjacent vertical members to define a wall having an expansion joint between each adjacent panel with the respective shim.

* * * * *